United States Patent [19]

Greer

[11] 4,394,189

[45] * Jul. 19, 1983

[54] HIGH PERFORMANCE TUBULARS FOR CRITICAL OIL COUNTRY APPLICATIONS AND IMPROVED PROCESS FOR THEIR PREPARATION

[75] Inventor: James B. Greer, Houston, Tex.

[73] Assignee: Lone Star Steel Company, Dallas, Tex.

[ * ] Notice: The portion of the term of this patent subsequent to Oct. 19, 1999, has been disclaimed.

[21] Appl. No.: 387,793

[22] Filed: Jun. 14, 1982

Related U.S. Application Data

[63] Continuation-in-part of Ser. No. 261,919, May 8, 1981, Pat. No. 4,354,882.

[51] Int. Cl.[3] ..... C21D 9/08

[52] U.S. Cl. ..... 148/12 R; 148/12 F; 148/12.4; 148/36

[58] Field of Search ..... 148/2, 12 R, 12 F, 12.4, 148/36, 144

[56] References Cited

U.S. PATENT DOCUMENTS

| | | | |
|---|---|---|---|
| 2,825,669 | 3/1958 | Herzog | 148/36 |
| 3,992,231 | 11/1976 | Timmons | 75/126 C |
| 4,226,645 | 10/1980 | Waid et al. | 148/36 |
| 4,282,047 | 8/1981 | Yamagata et al. | 148/36 |
| 4,354,882 | 10/1982 | Greer | 148/36 |

FOREIGN PATENT DOCUMENTS

| | | | |
|---|---|---|---|
| 604069 | 8/1960 | Canada | 148/36 |
| 2756191 | 7/1978 | Fed. Rep. of Germany | 148/36 |
| 55-97423 | 7/1980 | Japan | 148/36 |
| 791884 | 3/1958 | United Kingdom | 148/12 F |

OTHER PUBLICATIONS

Selcuk, "Specification of Steel for Producing Petroleum Tube by Extrusion," Metals Technology, May 1982, vol. 9, pp. 177–181.

*Primary Examiner*—Peter K. Skiff
*Attorney, Agent, or Firm*—Donald E. Degling

[57] ABSTRACT

A high performance carbon steel tubular for critical Oil Country applications and an improved process for its preparation are disclosed. The tubular is particularly adapted for use in deep wells where the tubular may be subjected to high pressure, wide temperature ranges, and/or corrosive environments, which may include hydrogen sulfide, carbon dioxide, and brine water, together with hydrocarbons. The process comprises forming a bloom from a modified 41XX killed steel, upset forging and piercing the steel bloom into a cylindrical extrusion billet, cold machining the inside and outside diameters of the extrusion billet to be concentric and cold machining the nose of the extrusion billet, reheating and extruding the billet to form an extruded shell, intercritically heat treating the shell, removing surface defects, cold working the tubular shell to finished dimensions, intercritically heat treating the sized tubular, and quenching and tempering the finished tubular.

23 Claims, No Drawings

HIGH PERFORMANCE TUBULARS FOR CRITICAL OIL COUNTRY APPLICATIONS AND IMPROVED PROCESS FOR THEIR PREPARATION

BACKGROUND OF THE INVENTION

This application is a continuation-in-part of application Ser. No. 261,919 filed May 8, 1981, now U.S. Pat. No. 4,354,882.

1. Field of the Invention

The present invention relates to tubulars for deep oil and gas wells and a process for the preparation of such tubulars. More particularly, the invention relates to tubulars, commonly known as Oil Country Tubular Goods (OCTG), for use in wells 15,000 to 35,000 feet deep, which may be subjected to high pressures, wide temperature ranges, and/or corrosive environments which may include hydrogen sulfide, carbon dioxide, and brine water along with hydrocarbons as constituents.

2. Discussion of the Prior Art

In recent years, work has been done to develop well tubulars having higher strength and better resistance to failure under severe stress and corrosive applications. This work was necessitated by the demand for tubulars suitable for use in deep wells in the range of 15,000 to 35,000 feet deep, where pressures and temperatures may exceed 15,000 psi and 250° F., respectively. In addition, the tubulars may be subjected to highly corrosive atmospheres containing large quantities of hydrogen sulfide ($H_2S$), carbon dioxide ($CO_2$), brine water, and/or associated hydrocarbons. Tubulars subjected to these conditions may fail in a matter of hours due to sulfide stress cracking.

The sulfide stress cracking characteristic of steel tubulars may be influenced by many factors, including the chemistry of the steel, the nature and amounts of alloying elements, the microstructure of the steel, the mechanical processing of the steel, and the nature of the heat treatment which may be provided.

Over the years, many attempts have been made to overcome the sulfide stress cracking problem in carbon steels, but prior to the present invention, no fully satisfactory solution has appeared.

The following patents illustrate the current state of the art.

A process for making seamless tubes using the so-called Pilger process, followed by reheating to forging temperatures (preferably in the neighborhood of 2100° F.), and subsequent finishing in a plug mill, reeler, and sizing mill, is shown in U.S. Pat. No. 1,971,829.

U.S. Pat. Nos. 1,993,842, 2,275,801, and 2,361,318 disclose casing in which the collapse resistance is increased by subjecting the casing to cold radial compression up to 2 percent or slightly greater.

U.S. Pat. No. 2,184,624 discloses a heat treatment above the upper critical point followed by slow cooling prior to cold drawing to improve the machining qualities of a tube.

U.S. Pat. No. 2,293,938 suggests a combination of cold working a hot-rolled tube in the range of 5 to 10 percent, followed by a heat treatment below the lower critical point to increase the collapse resistance and maintain ductility.

Another method for improving properties, such as collapse resistance, is shown in U.S. Pat. No. 2,402,383, which discloses sizing a tubular casing formed about 3 to 10 percent over size while at a temperature somewhat below the lower critical temperature in the range of 650° to 1000° F.

U.S. Pat. No. 2,825,669 seeks to overcome sulfide stress corrosion cracking in a low carbon (less than 0.20 C) composition by adding chromium and aluminum and heat treating in the range lying between $Ac_1$ and $Ac_3$ followed by an austenitizing heat treatment and an anneal. U.S. Pat. No. 2,825,669 also teaches that if the carbon is too high (e.g., above 0.20 C), the resistance to stress corrosion cracking is impaired.

Another approach to the stress corrosion problem in low carbon steel (0.10 to 0.25 C) by heat treating is disclosed in U.S. Pat. No. 2,895,861. In this patent, the steel is austenitized for about one hour, followed by air cooling. Thereafter, the steel is tempered above the $Ac_1$ point for about one hour.

U.S. Pat. No. 3,655,465 discloses a two-stage heat treatment for oil well casing involving an intercritical heat treatment to produce not more than 50 percent of an austenite decomposition product upon cooling. Thereafter, the product is tempered below the lower critical point.

U.S. Pat. No. 3,992,231 shows still another approach to the problem of overcoming sulfide stress cracking in SAE 41XX steels. In this process, the steel is austenitized, quenched, and thereafter temperstressed at a temperature below the transformation temperature by quenching the inner surface of the heated tube.

U.S. Pat. No. 4,032,368 discloses a process for reducing the time and energy required to perform an intercritical anneal for hypoeutectoid steel.

In U.S. Pat. No. 4,040,872, a method for strengthening a hypoeutectoid steel is disclosed. This comprises rapidly heating the steel into the austenite range (1350° to 2000° F.), quenching it, and then providing substantial cold working below the lower critical temperature.

Finally, in U.S. Pat. No. 4,226,645, a well casing having improved hydrogen sulfide stress cracking resistance is proposed. This patent discloses a tubular formed from an aluminum-killed steel containing controlled amounts of molybdenum, vanadium, and chromium, which is heat treated by austenitizing in the range of 1550° to 1700° F., quenching, and then tempering at 1200° to 1400° F. to produce a maximum hardness of 35 Rockwell C.

Specifications for deep well tubulars have been prepared by the American Petroleum institute and various users. Such specifications describe grades of tubulars having yield strengths of, for example, 80,000, 90,000, 95,000, 110,000, 125,000, and 140,000 psi. A typical chemical composition for a modified 41XX steel for a 90,000 psi grade is specified in Table I, below.

TABLE I

| Constituent | Min. % | Max. % |
|---|---|---|
| Carbon | .20 | .35 |
| Manganese | .35 | .90 |
| Chromium | .75 | 1.50 |
| Molybdenum | .15 | .75 |
| Nickel | — | .25 |
| Copper | — | .35 |
| Phosphorus | — | .04 |
| Sulfur | — | .04 |
| Silicon | — | .35 |

The steel is fully killed and has a grain size of ASTM 5 or finer. The modification of the 41XX composition is principally an increase in the quantity of chromium and molybdenum as shown, for example, in NACE Standard MR-01-75, ¶3.3.3. The specification provides for an inside-outside quench following an austenitizing treatment so as to result in at least 90 percent martensite in the as-quenched condition. After tempering, the final hardness is specified in the range of 18 through 25 Rockwell C. Any surface defects, such as inclusions, laps, seams, tears, or blow holes, are required to be removed by grinding or machining to provide a minimum wall thickness of at least 87.5 percent of the nominal wall thickness.

BRIEF SUMMARY OF THE INVENTION

The present invention resulted from applicant's efforts to produce a premium product which would meet or exceed the above specifications for a 90,000 psi minimum yield strength tubular, as well as other grades of similar tubulars, such as those having minimum yield strengths of 80,000, 95,000, 110,000, 125,000 and 140,000 psi.

A modified AISI 41XX steel is appropriate for the practice of the present invention. Preferably, applicant employs the composition range shown in Table II, below.

TABLE II

| Constituent | Min. % | Max. % | Typical % |
|---|---|---|---|
| Carbon | 0.20 | 0.35 | 0.27 |
| Manganese | 0.40 | 0.70 | 0.50 |
| Phosphorus | — | 0.010 | 0.005 |
| Sulfur | — | 0.010 | 0.005 |
| Silicon | 0.20 | 0.40 | 0.25 |
| Copper | — | 0.35 | 0.15 |
| Chromium | 0.75 | 1.20 | 0.90 |
| Molybdenum | 0.20 | 0.60 | 0.20–0.60* |
| Nickel | — | 0.25 | 0.15 |
| Vanadium | 0.06 | 0.15 | 0.08 |

*Molybdenum content will vary with wall thickness.

The steel is refined, preferably in an electric arc furnace using a double slag process, and continuously cast into blooms or billets having a substantially square cross section. In accordance with the present invention, the blooms are heated and upset forged in a cylindrical closed die and then pierced while in the die so as to form a pierced cylindrical extrusion billet. Thereafter the extrusion billet is fully machined on the inside diameter, outside diameter and the nose end is contoured. The machined extrusion billet is reheated and extruded to form a heavy wall extruded shell where the cross-sectional area of the extruded shell may be in the range of 10 to 40 percent over size with respect to the finished tubular. Following the extrusion step, in accordance with the invention, the extruded shell is subjected to an intercritical heat treatment by which the grain size of the material is refined. Thereafter, the heavy wall extruded shell is examined for defects and exterior defects are removed by contour grinding. In accordance with another feature of the invention, the shell thereafter is sized by substantial cold working. Following cold working, a second intercritical heat treatment is provided by the invention, as will be explained more fully below. Finally, the sized tubular is finished by a quench and temper process. Preferably, the quench is of the inside-outside type, particularly where heavy wall casing is involved. Typical tempering temperatures for the several grades of high performance tubulars are set forth in Table III, below.

TABLE III

| Yield Strength (psi) | Typical Tempering Temperature (°F.) |
|---|---|
| 80,000 | 1300 |
| 90,000 | 1275 |
| 95,000 | 1265 |
| 110,000 | 1235 |
| 125,000 | 1200 |
| 140,000 | 1165 |

The finished tubular of the present invention is virtually defect-free, easily inspectable, and characterized by improved drift diameter. It has a closely controlled yield strength range with a correspondingly narrow range of hardenss. The microstructure is characterized by a fine grain which is substantially tempered martensite, while the properties are characterized by an improved resistance to sulfide stress cracking, high toughness, and a high collapse strength.

DETAILED DESCRIPTION OF THE INVENTION

As shown in Table II, above, applicant has used relatively narrow ranges of chemical composition for his high performance tubulars for critical oil country applications. This composition has been selected so as to minimize alloy segregation while providing excellent hardenability and toughness. In order to achieve a high degree of cleanliness, it is preferable to refine the steel composition in an electric arc furnace using a double slag technique. Such a process is capable of producing closely controlled heats within the desired ranges of chemistry, including the very low levels of sulfur and phosphorus. The level of molybdenum depends upon tubular wall thickness, higher levels being used for greater wall thickness.

Although the refining technique is useful in achieving cleanliness, it is preferable to cast the finished heat by a continuous casting process rather than an ingot process, as the higher controlled cooling rates associated with continuous casting inhibit segregation in the bloom or billet.

It has been noted above that a fine grain structure is desirable in the finished tubular. This may more readily be attained if, at each step in the process, consideration is given to the effect of that process step on grain size and other properties. Thus, since applicant contemplates employing an extrusion process to prepare the extruded shell, the piercing step is the first point at which refining of the as-cast grain structure can begin and ultimate concentricity of the inside and outside finished walls affected. The substantially square cross section blooms produced by the continuous casting process are induction heated to about 2200° F. and upset forged in a cylindrical closed die to form a cylindrical extrusion billet. While still in the die the billet is pierced in the area which will become the tubular I.D. Preferably glass is used as a lubricant and oxidation barrier during the upset-pierce and subsequent extrusion operations. The forged and pierced billet is then cooled.

To improve concentricity, applicant machines the blooms or billets to produce a true cylindrical external surface which is free from scale and then bores a concentric internal diameter. With the establishment of concentric inside and outside surfaces, the bloom or billet may, if desired, be forged to expand the inside diameter prior to extrusion. The nose of the extrusion billet is also specially contoured by machining prior to extrusion. Such machining accomplishes defect removal of potential laps and seams and assures maximum concentricity of the tubular following the subsequent extrusion step. The upset forging step provides an initial refining of the as-cast grain structure.

Applicant prepares the tubular form, preferably by an extrusion or similar process to form an extruded shell. During the hot forming extrusion process, considerable forging or working is accomplished with a corresponding refinement of the grain structure through additional distortion of the original as-cast grain structure. The extrusion process, however, has a particular advantage in the present invention. Surface defects, which may still remain in the extrusion billet or which may be introduced during processing, will appear as elongated axially-located defects on the surface of the extruded shell. Because the defects are positioned axially instead of helically on the surface of the tubular form (as occurs in the rotary piercing process), they can more easily be removed by contour grinding.

Following extrusion, applicant performs an intercritical heat treatment followed by defect removal. For steel compositions containing about 0.30 percent C, the lower critical temperature ($Ac_1$) is about 1375° F., while the upper critical temperature ($Ac_3$) is about 1500° F. Below the $Ac_1$ point, the composition comprises pearlite and ferrite, while between the $Ac_1$ and $Ac_3$ points, the composition comprises austenite and ferrite. Above the $Ac_3$ point, the composition is entirely austenitic. Within the intercritical range, the ratio of ferrite and austenite depends on the temperature under equilibrium conditions: at close to 1500° F. (for a steel containing 0.30 percent C), the composition is almost entirely austenite with only small amounts of ferrite. On the other hand, at 1375° F., the composition will contain ferrite as the major component. Thus, the temperature at which the intercritical heat treatment is performed determines the ratio between ferrite and austenite. On the other hand, the time of the heat treatment is not significant so long as sufficient time is allowed for the extruded shell to attain a uniform temperature so as to approximate equilibrium conditions. Intercritical heat treatment times in the range of 15 minutes to one hour are contemplated for an extruded shell having a wall thickness in the range of ½ to 1 inch.

Applicant has discovered that the intercritical heat treatment should be carried out at a point preferably just below the $Ac_3$ point, i.e., at about 1475° F., for steels having a carbon content of about 0.30 percent. At this temperature, the grain structure will tend to recrystallize as relatively smaller grains. Following the intercritical heat treatment, cooling may be accomplished by any convenient manner, as such cooling is not critical.

In accordance with a further feature of the invention, the extruded shell, initially extruded so as to be 10 to 40 percent over size, is then cold worked to specified size. This cold working may be accomplished by Pilgering, rolling, swaging, or drawing, although cold working over a mandrel is preferred. Where the subsequent cold working is in excess of 10 percent, a significant degree of grain size refinement, after heat treatment, can occur. Preferably, the cold working during this step of the process is on the order of 20 percent so that a substantial degree of grain size refinement can be accomplished. This results in increased toughness and improved sulfide stress cracking resistance, properties significant in high pressure deep well tubulars.

Cold working to size after removal of surface defects by grinding produces another improved effect. Particularly where the cold working is performed over a mandrel, the process tends to "iron-out" or smooth out the contour ground surface so as to reduce the average depth of the ground area. Where cold working of about 20 percent is accomplished, original ground areas as deep as 30 percent of the wall thickness can be reduced to less than 5 percent of the nominal wall thickness. This has an additional advantage in that, from a fracture mechanics analysis, the toughness requirement for the product is decreased when the defect depth is reduced.

It will be appreciated that, where a mandrel is involved in the cold working process, surface irregularities on the interior surface of the tubular tend to be "ironed-out" as well as those on the exterior surface. This produces a smooth and highly inspectable product. In addition, the cold working over a mandrel process permits a closer control from end to end of the inside and outside diameters of the tubulars and the roundness of the tubulars. These characteristics are interrelated and improve the quality of the tubulars in several respects. First, the reduction in wall thickness variation resulting from the elimination or reduction of contour ground areas increases the collapse strength of the tubulars. Second, the improved control over wall thickness, roundness, and concentricity (resulting from reduced defect depth) permits the tubulars to be manufactured closer to the tolerance limits for the inside and outside diameters, thereby increasing the drift diameter of the tubulars. API drift is defined as: Nominal OD-2t-size tolerance, where OD=Outside Diameter and t=wall thickness.

Following the cold working to size step, preferably accomplished by cold working over a mandrel, applicant provides a second intercritical heat treatment wherein the sized tubular is again brought to a temperature between $Ac_1$ and $Ac_3$. At this time, the grain structure has been substantially distorted because of the cold working and contains strains generally along the slip planes of each grain. During the intercritical heat treatment, recrystallization occurs from an increased number of nucleation sites created by the cold working process and thereby further refines the structure. Due to the relatively low intercritical temperature, grain growth is inhibited. The time for the heat treatment is not critical, provided that sufficient time is provided for complete recrystallization. For tubulars having wall thicknesses ranging from ½ to 1 inch, times in the range of 15 minutes to one hour at temperature are acceptable.

As noted above, quench and temper steps are performed as final processing steps. Preferably, the sized tubular is soaked at a temperature in the range of 1650° to 1700° F. for the minimum time required to assure complete austenitization. This, in turn, minimizes grain growth. Where the wall thickness of the tubular is more than ½ inch, it is preferable to use an inside-outside water quench to assure that substantially complete transformation of the austenite to martensite occurs. Preferably, the temperature of the tubular after quenching is held to a maximum of 200° F.

After the quench, the tubular is heat treated to a tempered martensite structure at a temperature below $Ac_1$ to produce the required yield strength and hardness. For 80,000 to 140,000 psi yield strength materials, the tempering temperature generally will be in the range of 1100° to 1350° F.

As will be appreciated by those skilled in the art, it may be found desirable to straighten the tubular at one or more points in the process. Straightening may be performed by processes such as the well-known rotary straightening process.

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified. Examples 1 and 2 demonstrate the improvement in sulfide stress cracking resistance developed in accordance with the process of the present invention while Examples 3 and 4 demonstrate the improvement in quality and dimensional control (e.g., the improvement in wall thickness uniformity which provides improved drift) resulting from the fully machined extrusion billet.

EXAMPLES 1 AND 2

(Heats 63920 and 73355)

Tubulars were produced which bracketed the 90,000 to 105,000 psi yield strength range for a 90,000 psi minimum yield strength grade using two distinct manufacturing processes:

(1) Extrude, Q&T Heat Treatment (2) Extrude, (Normalize) Intercritical Heat Treatment—Draw Over Mandrel—Intercritical Heat Treatment, Q&T Heat Treatment.

The first of these processes corresponds to a standard method of manufacture for this grade tubular where a hot formed tube is heat treated to the proper strength range. The second process includes the applicant's intercritical heat treatment and cold working steps described herein, but is otherwise identical, as described below. Tube samples from each of these processes were tested according to the NACE TM-01-77 standard test method for characterization of their resistance to failure by sulfide stress cracking.

Heats having chemistries as shown in Table IV, below, were prepared in an electric arc furnace using a double slag process and continuously cast into 12,486-inch modified square blooms for piercing and extrusion.

TABLE IV

| Constitutent | Heat 63910 | Heat 73355 |
|---|---|---|
| Carbon | 0.30 | 0.32 |
| Manganese | 0.57 | 0.79 |
| Phosphorus | 0.016 | 0.009 |
| Sulfur | 0.021 | 0.011 |
| Silicon | 0.25 | 0.34 |
| Copper | 0.24 | 0.21 |
| Chromium | 1.20 | 1.03 |
| Molybdenum | 0.54 | 0.24 |
| Nickel | 0.14 | 0.10 |
| Tin | 0.012 | 0.009 |
| Vanadium | 0.096 | 0.12 |
| Aluminum | 0.004 | 0.005 |

The blooms were pierced and then extruded to a diameter of 7.8 inches on two occasions. First, to assess the efficiency of the martensitic transformation upon quenching, tubulars were extruded for nominal 7⅝ inch OD having 0.500 and 1.200 inch wall thicknesses. These tubulars were austenitized for about 45 minutes at 1675° F. and simultaneously inside and outside water quenched to 200° F. maximum. The tubulars were tempered at about 1250° and 1300° F. for about one hour to produce the range of yield strength shown in Table V. The tempered tubulars were cooled with a water spray. Table V also shows the results of sulfide stress cracking tests performed on these tubulars.

Next, tubular shells were extruded as 7⅝ inch OD and 0.712 inch wall thickness from blooms from the same two heats previously used. The extruded shells were subjected to an intercritical heat treatment of 1475° F. for about 20 minutes with slow cooling through the transformation range, followed by contour grinding of the OD scores, etc. The extruded and conditioned shells are drawn over a mandrel to produce a 7-inch OD tube having a wall thickness of 0.625 inch. Such drawing represented a reduction in area of about 20 percent. Thereafter, a second intercritical heat treatment was performed at 1475° F. for 20 minutes and cooled slowly through the transformation range.

These tubulars were austenitized for about 45 minutes at 1675° F. and simultaneously inside and outside water quenched to 200° F. maximum. The austenitized and quenched tubulars were tempered at about 1285° for 45 minutes and cooled with a water spray. Table VI shows the results of tubes 35 and 41 from this trial processing run. These tubes were selected because tube 41 had received a 1700° F. normalizing treatment just prior to the first intercritical heat treatment while tube 35 did not receive the normalizing treatment.

TABLE V

SULFIDE STRESS CRACKING DATA FOR EXTRUDED AND QUENCH AND TEMPERED HEAT TREATED TUBULARS

| Sample Description | Approximate Yield Strength, psi | Applied Stress, psi/Exposure Time, Hours | | | | | |
|---|---|---|---|---|---|---|---|
| | | 95,000 | 90,000 | 85,000 | 80,000 | 75,000 | 70,000 |
| Heat 73355 | | | | | | | |
| 7⅝" × 0.500" | 91,500 | — | (12.4) | 720 NF | 720 NF | (217) | — |
| Tube No. 59 | | | | | 720 NF | 720 NF | |
| | | | | | | 720 NF | |
| 7⅝" × 1.200" | 88,500 | — | (33) | (624) | 720 NF | 720 NF | — |
| Tube No. 38 | | | | | | 720 NF | |
| 7⅝" × 1.200" | 105,000 | (13.1) | (26) | 720 NF | 720 NF | 720 NF | |
| Tube No. 55 | | | | | | 720 NF | |
| Heat 63920 | | | | | | | |
| 7⅝" × 0.500" | 91,000 | — | — | — | 720 NF | 720 NF | |
| Tube No. 57 | | | | | | 720 NF | |
| 7⅝" × 1.200" | 86,000 | — | (41.6) | 720 NF | 720 NF | 720 NF | |

TABLE V-continued

SULFIDE STRESS CRACKING DATA FOR EXTRUDED AND QUENCH AND TEMPERED HEAT TREATED TUBULARS

| Sample Description | Approximate Yield Strength, psi | Applied Stress, psi/Exposure Time, Hours 95,000 | 90,000 | 85,000 | 80,000 | 75,000 | 70,000 |
|---|---|---|---|---|---|---|---|
| Tube No. 39 | | | | | | 720 NF | |

( ) Exposure time in hours at failure.
720 NF - Test completed to 720 hour exposure time without failure.

TABLE VI

SULFIDE STRESS CRACKING DATA FOR EXTRUDED, INTERCRITICAL HEAT TREATED - DRAWN OVER MANDREL-INTERCRITICAL HEAT TREATED, Q&T HEAT TREATED TUBULARS

| Sample Description | Approximate Yield Strength, psi | Applied Stress, psi/Exposure Time, Hours 95,000 | 90,000 | 85,000 | 80,000 | 75,000 | 70,000 |
|---|---|---|---|---|---|---|---|
| Heat 73355 | | | | | | | |
| 7" × 0.625" Tube No. 35 | 94,900 | (36.1) | (16.7) 720 NF | 720 NF 720 NF 720 NF 720 NF | 720 NF | 720 NF | 720 NF |
| 7" × 0.625" Tube No. 41 | 100,200 | (7.5) | 720 NF 720 NF 720 NF 620 NF* | 720 NF 720 NF 720 NF | 720 NF | (28.3) | 720 NF |

( ) - Exposure time in hours at failure.
720 NF - Test completed to 720 hour exposure without failure.
*620 NF - Test terminated by severe weather at laboratory.

A comparison of the sulfide stress cracking results for the tubes manufactured by the conventional and new processes with all other conditions controlled as nearly identical as possible may be made using the data shown in Tables V and VI. Table V, for the conventional process, shows a threshold stress (no failure in 720 hours exposure time) for the two heats and wall thicknesses of 80,000 to 85,000 psi applied stress. Table VI shows a definite improvement in threshold stress to 85,000 to 90,000 psi applied stress. In both tables, an anomalous failure at 75,000 psi is noted. Since time-to-failure ordinarily shortens appreciably for higher stresses, an examination of the overall data trend indicates that an experimental error is likely for these two specimens. In this accelerated laboratory test, a commonly-accepted passing threshold stress is 75 percent of specified minimum yield strength, or 67,500 psi for this grade. Although both processes would be considered as passing these requirements, the increase in threshold stress for the new process is considered significant since passing tests at 90,000 psi applied stress are not common. No significant difference is noted between tube 41 from the new process described herein and tube 35 which received an additional normalizing step prior to the first intercritical heat treatment. The improvement in resistance to sulfide stress cracking shown by the data in Tables V and VI is felt to be the result of the intercritical heat treatment and cold working steps employed. Similar improvement would be expected for the new process over the conventional process for commensurately higher strength grades which are employed in less severe (for example, elevated temperature or lower hydrogen sulfide concentration) applications.

EXAMPLES 3 AND 4

(Heats 73663, 73657, 73661A, and 73665)

Heats 73663 and 73657 (Example 3) were extruded from billets pierced in accordance with a prior art practice while Heats 73661A and 73665 (Example 4) were extruded from fully machined billets prepared in accordance with the process of the present invention. Tables VII and VIII below contain measurements made on the extruded shells, Table VII contains the data for Heats 73663 and 73657, while Table VIII contains the data for Heats 73661A and 73665.

TABLE VII

Extruded Shell Wall Eccentricity, As-Pierced Bore (7.783" O.D. × 0.850" wall thickness extruded shell)

| | Pipe No. | Wall Eccentricity, Inches Push End | Midlength | Nose |
|---|---|---|---|---|
| Heat 73663 | 1 | .051 | .173 | .115 |
| | 2 | .069 | .104 | .059 |
| | 3 | .058 | .097 | .043 |
| Average | | .059 | .125 | .072 |
| Std. Deviation | | .009 | .042 | .038 |
| Heat 73657 | 1 | .083 | .077 | .021 |
| | 2 | .067 | .041 | .038 |
| | 3 | .033 | .054 | .023 |
| | 4 | .104 | .054 | .023 |
| | 5 | .043 | .143 | .059 |
| | 6 | .053 | .142 | .054 |
| | 7 | .045 | .098 | .037 |
| | 8 | .061 | .021 | .062 |
| Average | | .061 | .079 | .040 |
| Std. Deviation | | .023 | .045 | .017 |

TABLE VII

Extruded Shell Wall Eccentricity for ID Bored Billets (7.783" O.D. × 0.805 wall thickness extruded shell)

| | Pipe No. | Wall Eccentricity, Inches Push End | Midlength | Nose |
|---|---|---|---|---|
| Heat 73661A | 1 | .017 | .044 | .031 |
| | 2 | .039 | .028 | .022 |
| | 3 | .045 | .032 | .024 |
| | 4 | .015 | .035 | .046 |
| | 5 | .034 | .039 | .040 |
| | 6 | .028 | .038 | .031 |
| | 7 | .077 | .026 | .031 |
| | 8 | .050 | .048 | .047 |
| | 9 | .023 | .015 | .028 |
| | 10 | .054 | .056 | .050 |
| Average | | .038 | .036 | .035 |

TABLE VII-continued

Extruded Shell Wall Eccentricity for ID Bored Billets (7.783" O.D. × 0.805 wall thickness extruded shell)

| | Pipe No. | Wall Eccentricity, Inches Push End | Midlength | Nose |
|---|---|---|---|---|
| Std. Deviation | | .019 | .012 | .010 |
| Heat 73665 | 1 | .031 | .039 | .016 |
| | 2 | .029 | .031 | .036 |
| | 3 | .013 | .016 | .029 |
| | 4 | .027 | .045 | .007 |
| | 5 | .010 | .017 | .045 |
| | 6 | .017 | .019 | .013 |
| | 7 | .053 | .031 | .025 |
| | 8 | .027 | .038 | .055 |
| | 9 | .033 | .018 | .052 |
| | 10 | .017 | .030 | .010 |
| | 11 | .030 | .015 | .025 |
| | 12 | .035 | .018 | .029 |
| | 13 | .014 | .018 | .020 |
| Average | | .026 | .026 | .028 |
| Std. Deviation | | .012 | .010 | .015 |

Table IX below summarizes the measurements shown in Tables VII and VIII above.

TABLE IX (Summary of Tables VII and VIII)

| | Average Wall Eccentricity (inches) | Standard Deviation ($\sigma$) |
|---|---|---|
| As Pierced | .059 | .009 |
| | .125 | .042 |
| | .072 | .038 |
| | .061 | .023 |
| | .079 | .045 |
| | .040 | .017 |
| Grand Average | .073 | .029 |
| % of Wall Thickness | 8.5% | 3.4% |
| Bored | .038 | .019 |
| | .036 | .012 |
| | .035 | .010 |
| | .026 | .012 |
| | .026 | .010 |
| | .028 | .015 |
| Grand Average | .032 | .013 |
| % of Wall Thickness | 3.7% | 1.5% |

As shown by Table IX, both the average values of the concentricity measurements and the standard deviations of those measurements are substantially larger for the extruded shells produced by the prior art piercing process than for those produced by the process of the present invention. These values may be translated into percent eccentricity values by reference to the nominal wall thickness of the extruded shells (0.850"). Thus the as pierced shells had an 8.5% eccentricity with a standard deviation of 3.4%, while the machined shells had a 3.7% eccentricity with a standard deviation of 1.5%. As the heats shown in Tables VII and VIII were run through the extruder consecutively in a single extrusion run, they include a constant value due to whatever misalignment may have been present in the extruder at that time. Thus, the relative improvement due to the present invention is greater than is suggested by these figures.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for manufacturing high performance tubulars having minimum yield strengths ranging from 80,000 to 140,000 psi characterized by improved sulfide stress cracking resistance and improved dimensional control comprising the steps of providing a killed steel bloom comprising in amounts by weight 0.20 to 0.35 percent carbon, 0.35 to 0.90 percent manganese, 0.75 to 1.50 percent chromium, 0.15 to 0.75 percent molybdenum, 0.25 percent maximum nickel, 0.35 percent maximum copper, 0.040 percent maximum phosphorus, 0.04 percent maximum sulfur, 0.35 percent maximum silicon, and the balance iron, except normal steelmaking impurities, upset forging the killed steel bloom in a closed end cylindrical die to form an extrusion billet, hot piercing the extrusion billet while still in the upset forging die, cold machining the outside diameter and the inside diameter to be concentric and cold machining the nose of the extrusion billet, reheating and extruding the extrusion billet to form an extruded shell wherein the cross-sectional area of the extruded shell is in the range of 10 to 40 percent larger than the cross-sectional area of the finished tubular, subjecting the extruded shell to a first intercritical heat treatment to recrystallize and refine the grain structure, removing surface defects by grinding, sizing the ground, heat treated extruded shell by cold working to the finished tubular dimensions, subjecting the sized tubular to a second intercritical heat treatment to recrystallize and refine the grain structure, and subjecting the finished tubular to a quench and temper process wherein the tubular is austenitized, quenched, and tempered to produce a substantially tempered martensitic structure having a minimum yield strength in the range of 80,000 to 140,000 psi.

2. A process according to claim 1, in which the steel consists essentially in amounts by weight of from 0.20 to 0.35 percent carbon, 0.40 to 0.70 percent manganese, 0.20 to 0.40 percent silicon, 0.75 to 1.20 percent chromium, 0.20 to 0.60 percent molybdenum, 0.06 to 0.15 percent vanadium, and the balance iron, except normal steelmaking impurities.

3. A process in accordance with claim 1, in which the steel is refined in an electric arc furnace and continuously cast into blooms.

4. A process in accordance with claim 3 in which the refining step employs a double slag process to minimize the sulfur and phosphorus content of the steel.

5. A process in accordance with claim 1, in which the first intercritical heat treatment is performed by holding the extruded shell at a temperature in the range between the $Ac_1$ and $Ac_3$ temperatures for a period of 15 minutes to one hour.

6. A process according to claim 1, in which surface defects are removed by contour grinding.

7. A process according to claim 1, in which the ground heat treated extruded shell is cold worked to finished size by drawing said extruded shell over a mandrel.

8. A process according to claim 1, in which the second intercritical heat treatment is performed by holding the sized tubular at a temperature in the range between the $Ac_1$ and $Ac_3$ temperatures for a period of 15 minutes to one hour.

9. A process according to claim 2, in which the quench and temper process comprises an inside-outside water quench from a temperature in the austenitizing range of 1650° to 1700° F. to a temperature in the range of 100° to 200° F.

10. A process according to claim 2, in which the sized tubular is tempered at a temperature in the range of 1250° F. to 1350° to produce a yield strength range of 80,000 to 95,000 psi.

11. A process according to claim 2, in which the sized tubular is tempered at a temperature in the range of 1250° to 1325° F. to produce a yield strength range of 90,000 to 105,000 psi.

12. A process according to claim 2, in which the sized tubular is tempered at a temperature in the range of 1225° to 1300° F. to produce a yield strength range of 95,000 to 110,000 psi.

13. A process according to claim 2, in which the sized tubular is tempered at a temperature in the range of 1200° to 1275° F. to produce a yield strength range of 110,000 to 125,000 psi.

14. A process according to claim 2, in which the sized tubular is tempered in a temperature in the range of 1150° to 1250° F. to produce a yield strength range of 125,000 to 140,000 psi.

15. A process according to claim 2, in which the sized tubular is tempered at a temperature in the range of 1100° to 1200° F. to produce a yield strength range of 140,000 to 155,000 psi.

16. A process for manufacturing high performance tubulars having minimum yield strengths ranging from 80,000 to 140,000 psi characterized by improved sulfide stress cracking resistance and improved dimensional control, comprising the steps of providing a killed steel bloom consisting essentially in amounts by weight of from 0.20 to 0.35 percent carbon, 0.40 to 0.70 percent manganese, 0.20 to 0.40 percent silicon, 0.75 to 1.20 percent chromium, 0.20 to 0.60 percent molybdenum, 0.06 to 0.15 percent vanadium, and the balance iron, except normal steelmaking impurities, upset forging the killed steel bloom in a closed end cylindrical die to form an extrusion billet, hot piercing the extrusion billet while still in the upset forging die, cold machining the outside diameter and the inside diameter to be concentric and cold machining the nose of the extrusion billet, reheating and extruding the extrusion billet to form an extruded shell wherein the cross-sectional area of the extruded shell is in the range of 10 to 40 percent larger than the cross-sectional area of the finished tubular, subjecting the extruded shell to a first intercritical heat treatment to recrystallize and refine the grain structure, removing surface defects by grinding, sizing the ground, heat treated extruded shell by cold working to the finished tubular dimensions, subjecting the sized tubular to a second intercritical heat treatment to recrystallize and refine the grain structure, and subjecting the finished tubular to a quench and temper process wherein the tubular is austenitized, quenched, and tempered to produce a substantially tempered martensitic structure having a minimum yield strength in the range of 80,000 to 140,000 psi.

17. A process according to claim 16, in which the sized tubular is tempered at a temperature in the range of 1250° to 1350° F. to produce a yield strength in the range of 80,000 to 95,000 psi.

18. A process according to claim 16, in which the sized tubular is tempered at a temperature in the range of 1250° to 1325° F. to produce a yield strength in the range of 90,000 to 105,000 psi.

19. A process according to claim 16, in which the sized tubular is tempered at a temperature in the range of 1225° to 1300° F. to produce a yield strength in the range of 95,000 to 110,000 psi.

20. A process according to claim 16, in which the sized tubular is tempered at a temperature in the range of 1200° to 125° F. to produce a yield strength in the range of 110,000 to 125,000 psi.

21. A process according to claim 16, in which the sized tubular is tempered at a temperature in the range of 1150° to 1250° F. to produce a yield strength in the range of 125,000 to 140,000 psi.

22. A process according to claim 16, in which the sized tubular is tempered at a temperature in the range of 1100° to 1200° F. to produce a yield strength in the range of 140,000 to 155,000 psi.

23. A high performance tubular made in accordance with the process set forth in any one of claims 1, 2, or 16.

* * * * *

UNITED STATES PATENT AND TRADEMARK OFFICE

CERTIFICATE OF CORRECTION

PATENT NO. : 4,394,189

DATED : July 19, 1983

INVENTOR(S) : James Brison Greer

It is certified that error appears in the above-identified patent and that said Letters Patent are hereby corrected as shown below:

At column 2, line 48, "institute" should be --Institute--.

At column 4, line 14, "hardenss" should be --hardness--.

At column 5, line 53, "by" should be --in--.

At column 7, line 45, "12,486" should be --12.486--.

At column 8, line 35, "are" should be --were--.

At column 10, line 55, "Table VII" should be --Table VIII--.

At column 11, line 1, "Table VII" should be --Table VIII--.

At column 10, line 57, "0.805" should be --0.850"--.

At column 11, line 3, "0.805" should be --0.850"--.

UNITED STATES PATENT AND TRADEMARK OFFICE

CERTIFICATE OF CORRECTION

PATENT NO. : 4,394,189

DATED : July 19, 1983

INVENTOR(S) : James Brison Greer

It is certified that error appears in the above—identified patent and that said Letters Patent is hereby corrected as shown below:

At column 13, line 3, "1250°F to 1350°" should be --1250° to 1350°F--.

At column 13, line 18, "in a temperature" should be --at a temperature--.

At column 14, line, 29 "125°F" should be --1275°F--.

Signed and Sealed this

Tenth Day of April 1984

[SEAL]

*Attest:*

GERALD J. MOSSINGHOFF

*Attesting Officer*

*Commissioner of Patents and Trademarks*